United States Patent [19]

Zahn et al.

[11] 4,274,222

[45] Jun. 23, 1981

[54] CONSTRUCTION ELEMENT AND THROWING TOY MADE THEREFROM

[76] Inventors: David C. Zahn; Anči B. Slovak, both of R.F.D. #1, Box 177, East Calais, Vt. 05650

[21] Appl. No.: 29,727

[22] Filed: Apr. 13, 1979

[51] Int. Cl.[3] ..... A63H 33/10

[52] U.S. Cl. ..... 46/29

[58] Field of Search ..... 46/27, 28, 29

[56] References Cited

U.S. PATENT DOCUMENTS

| | | | |
|---|---|---|---|
| 1,347,808 | 7/1920 | Franklin | 46/29 |
| 3,148,539 | 9/1964 | Cook | 46/29 |
| 3,432,960 | 3/1969 | Bombaci | 46/29 |
| 3,469,339 | 9/1969 | Thomas | 46/28 |

*Primary Examiner*—Robert A. Hafer

*Attorney, Agent, or Firm*—Cooper, Dunham, Clark, Griffin & Moran

[57] ABSTRACT

A construction element, which may be used in constructing flexible universal joints for a variety of geometrical structures such as assembly toys and in combination with rods to particularly construct a cube-octahedron throwing toy, is disclosed wherein the element comprises a section of elastic tubing having diametrically opposed cutouts at its center to form a transverse opening adapted to receive a similar piece of tubing or other member. By inserting one of such elements through the cutouts in another of the elements until the cutouts register, they may be compressively held together and form a universally flexible, self-centering, cruciform joint which can be connected to four rod-like members and used in combination with like elements and members in assembling various polyhedral structures such as the preferred embodiment of a manipulatable throwing toy. By virtue of their elasticity, more than two tube elements can be connected together into a single multielement joint or one or more can be connected to an alternate unitized cruciform joint embodiment.

17 Claims, 13 Drawing Figures

Fig. 1.
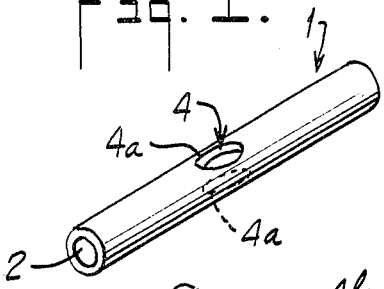
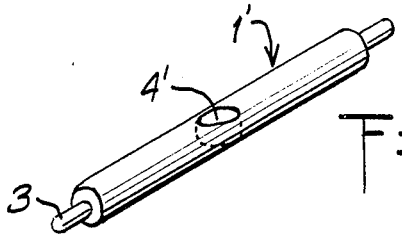
Fig. 2.
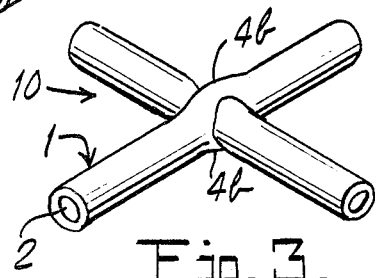
Fig. 3.
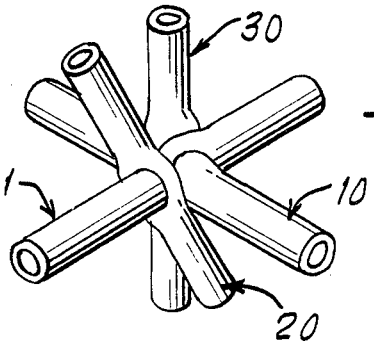
Fig. 4.
Fig. 5.
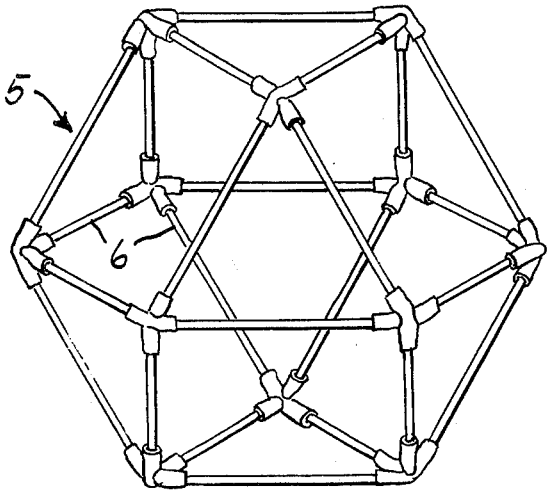
Fig. 6.
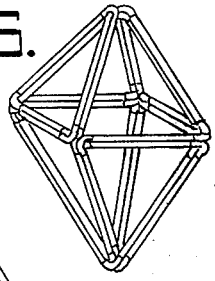
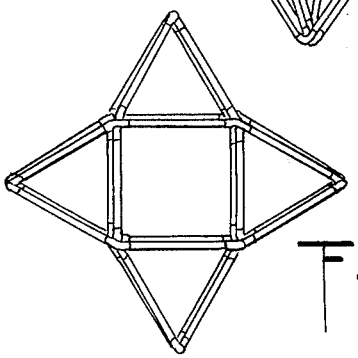
Fig. 7.
Fig. 9.
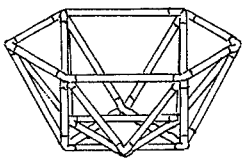
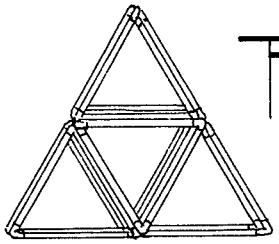
Fig. 8.

Fig. 11.
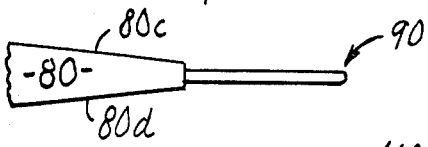
Fig. 12.
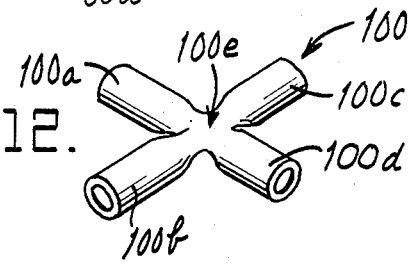
Fig. 13.
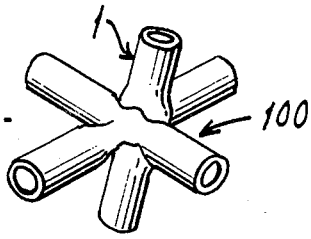
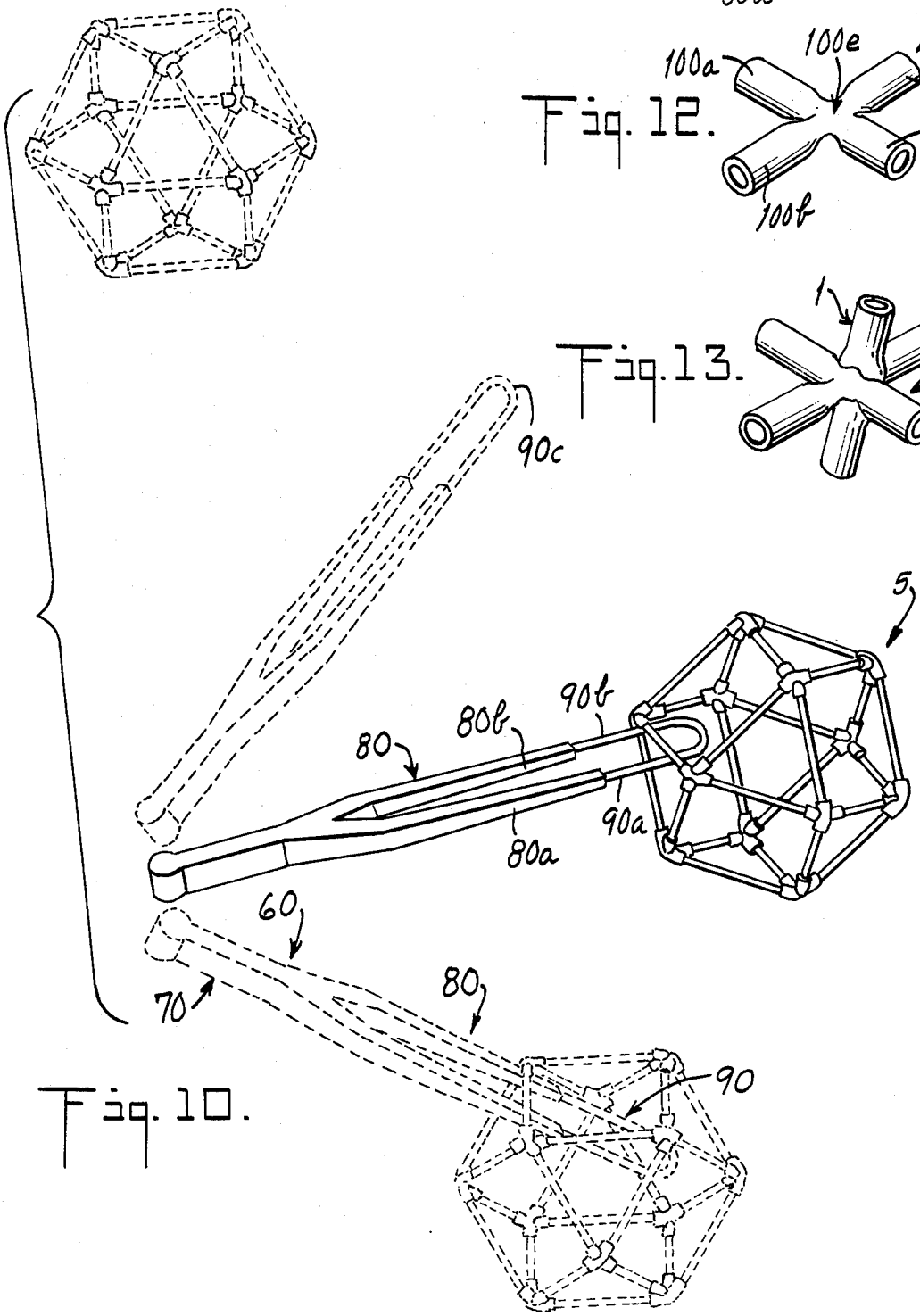
Fig. 10.

CONSTRUCTION ELEMENT AND THROWING TOY MADE THEREFROM

BACKGROUND OF THE INVENTION

The present invention relates to a construction element and particularly to an element suitable for forming a flexible joint useful in assembling geometrical structures and preferably a manipulatable throwing toy.

Geometric models and construction toys having flexible joints formed from one or more tubular members and tubular members which receive the ends of rod-like members are known in the art, such as evidenced by the respective showings in German D.R. Patentschrift No. 41316 to Naumann and Swiss Patentschrift No. 344665 to Liechti. Other examples of such joint-forming members may be found in Italian Pat. No. 545995 and U.S. Pat. Nos. 3,148,539, and 3,830,011, as well as in British Pat. No. 4568 and Australian Pat. No. 247160. In all of the cited embodiments it will be seen that the flexible joint is formed from a single utilized member which has been integrally molded or constructed, or from a number of members which have been tied together as in German Patentschrift No. 41316, or welded together as in U.S. Pat. No. 3,830,011. Thus the basic building block or element in constructing flexible joints of this type has heretofore required a complex molding or forming, or a complicated connecting operation.

U.S. Pat. No. 3,469,339 to Thomas discloses an assembly toy composed of cylindrical members with transverse openings therethrough of a diameter substantially the same as the diameter of the members except for the connecting portions at the sides of the openings. The material of the cylindrical members is plastic to permit the passage of one cylindrical member through the opening in another, and a third member is provided with a suitable bifurcated end which connects the two former members together upon insertion through the cooperating openings.

The present invention improves upon all of this prior art by providing a simple construction element which can be used in combination with like elements to form complex flexible joints that can achieve all of the results obtainable with the prior art joints and more without requiring any complex molding, forming or connecting. The resulting flexible joints can be used in combination with other structural members to construct virtually an infinite number of structures and particularly with a plurality of identical rods to construct a freestanding cube-octahedron that is suitable for use as an advantageous throwing toy.

SUMMARY OF THE INVENTION

The present invention comprehends a flexible construction element which as a fundamental building block may be used with like elements to form simple or complex flexible joints that in turn may be used with other structural elements, particularly rod-like members, to form components suitable in constructing a myriad of geometrical structures, and preferably to form a freestanding flexible cube-octahedron constituting an improved manipulatable throwing toy.

The basic construction element comprises a length of elastic material, preferably in the form of tubing, having diametrically-opposed cutouts or apertures in its surface that form a transverse opening therethrough whose maximum width or diameter is somewhat smaller than the outside diameter of the tubing to afford strength in tension in the connecting portions or side walls of the opening. By virtue of the elasticity of the tubing and the difference in the diameters, one such element may be drawn through the opening in another such element until their respective openings cooperate, whereupon they are securely held together by the compressive force of the sidewalls of the opening in the outer element without the need for any further locking or connecting means such as required with the elements shown in U.S. Pat. No. 3,469,339. In addition, the two interlocked elements may be inserted through the openings in further elements in like manner to form a flexible joint having a multiplicity of tubes extending from essentially a single vertex. These basic construction elements are preferably of a uniform size with the transverse openings located at or near their centers, so that they may be completely interchangeable in use. However, the invention also contemplates elements of differing length, with one or more openings therein near their ends or any other position along their lengths, to permit their use in constructing a virtually infinite number of flexible geometrical structures. Also, the elements may be hollow throughout their lengths, or through only a portion or portions of their lengths, and with axial channels or chambers of different diameters, and their ends may be formed in different manners for suitably connecting them to other cooperating structural elements.

A preferred use for or embodiment including the construction elements of the invention involves forming a flexible cruciform joint which in combination with suitable rod-like members acts as a component or building block in constructing an improved manipulatable and throwing toy. The toy is in the form of a freestanding hollow cube-octahedron with open faces including six squares and eight triangles. The triangular faces by their nature are rigid and the square faces by virtue of the flexible joints, each composed of two construction elements or suitably interconnected flexible tubes, are collapsible so that the structure by manipulation can be readily altered into a number of different geometrical forms. A particular advantage of the structure as a throwing toy results from the fact that its hollow construction offers minimum resistance to the air and when it is rotatably tossed centrifugal force will tend to flatten the structure upon itself, providing improved gliding characteristics. Further, when the structure strikes the ground or some other surface such as a window, the flexible joints again permit collapse or flattening, absorbing the propelling energy so as to impede bouncing and minimize the impact force. After such collisions, upon the expending of the propelling energy, the structure immediately returns to its freestanding cube-octahedron form. The flexible cruciform joints will also tend toward self-centering to maintain the proper form.

As the joints are of a flexible or elastic material, the toy has no sharp or rigid edges. The collapsibility of the structure is particularly important and of advantage when it is being used as a toy by young children, since it will flatten if fallen upon and no rigid or sharp ends are formed. Also in such instances, the elasticity of the joint material when surrounding the end of a rod-like member will increase the frictional engagement between the two upon the imposition of a force tending to draw them apart and thus impedes inadvertent release of the rod-like member from the joint.

BRIEF DESCRIPTION OF THE DRAWINGS

FIG. 1 is a perspective view of a preferred embodiment of the construction element of the present invention.

FIG. 2 is a perspective view of another embodiment of a construction element in accordance with the present invention.

FIG. 3 is a perspective view of a flexible joint formed by two construction elements of the type shown in FIG. 1.

FIG. 4 is a perspective view of a flexible joint formed by four construction elements of the type shown in FIG. 1.

FIG. 5 illustrates a freestanding cube-octahedron toy constructed in accordance with the present invention.

FIG. 6 illustrates the toy of FIG. 5 collapsed under pressure into octahedral form.

FIG. 7 illustrates the toy of FIG. 5 collapsed into a flat configuration.

FIG. 8 illustrates the toy of FIG. 5 collapsed under pressure into a flat triangular configuration.

FIG. 9 illustrates the toy of FIG. 5 with one side inverted against the other side in a freestanding regular bowl-like configuration.

FIG. 10 illustrates the toy of FIG. 5 being used as a throwing toy in combination with an improved throwing device in accordance with the present invention.

FIG. 11 is an enlarged side view of the forward portion of the throwing device shown in FIG. 10.

FIG. 12 is a perspective view of a flexible cruciform joint in accordance with the present invention having a unitized construction.

FIG. 13 is a perspective view of a multielement flexible joint formed by the joint of FIG. 12 in combination with a construction element as shown in FIG. 1.

DETAILED DESCRIPTION OF THE INVENTION

A construction element in accordance with the present invention is shown in FIG. 1. The element is formed from an elongated member 1 of a readily flexible, and preferably elastic, material such as rubber or a suitable polymer, typically polyethylene or polyurethane. The member 1 is preferably hollow to enhance its flexibility and thus has an axial channel 2 or circular or other suitable cross section extending through its full length. It is contemplated, however, that in some applications the element may be solid throughout its length or have intermittent solid and hollow portions or chambers, and the widths or diameters of the hollow portions may be uniform or different. Also, the ends of the element rather than opening into the interior of the member as in FIG. 1 may be closed and provided with a suitable protuberance or plug portion 3 as shown in FIG. 2 for cooperation with structural elements of other forms. Further, the opposite ends of the member may be formed in different manners, and its cross section may be other than circular.

In any event, the element is provided with a transverse opening 4 which may be formed by diametrically opposed cutouts or apertures **4*a* in tubing member 1, such as shown in FIG. 1, or a tunnel 4*b* through the solid member 1' as shown in FIG. 2. The opening 4, which may be circular or some other configuration, has a maximum width or diameter that is somewhat smaller than the periphery or outside diameter of the member itself so that the connecting portions or sidewalls 4*b* of the opening will have adequate strength in tension. As a result, when one element such as tubular member 1 has another member 10 pulled through its transverse opening 4 to the point where the respective openings cooperate, the side walls 4*b* of the opening in the receiving member 1, due to the elasticity of the two members and the differences in diameters, will compress the side walls of the opening in the received member 10 holding the two tubular members securely together as shown in FIG. 3. The cooperating outer tensed sidewalls and inner compressed sidewalls will cause the juncture of the two members to be self-centering. Also due to the flexibility of the tubing the resulting composite structure may be made to act as a universal joint when other structural elements are connected to the four tubular legs extending from the vertex to the joint. Further, by virtue of the elasticity, another element 20 may be disposed about element 1 and another element 30 may be disposed about element 10, as shown in FIG. 4**, to form a flexible joint having eight tubular legs extending essentially from a single vertex. It will be seen that it is possible to add many more elements by adjusting the dimensioning of the tubing and openings to form a universal joint having a considerable multiplicity of legs.

Thus, it will be appreciated that the basic construction element, no matter what its cross section, including the transverse opening, irrespective of its form, can be used as a fundamental construction piece for forming universal joints of untold configuration and complexity, as long as the element is sufficiently flexible and the width or diameter of the opening is such that the sidewalls have elasticity and sufficient strength in tension to receive like or other elements therein.

A particular structural embodiment utilizing such a joint, in this case made up of two elastic elements, is shown in FIG. 5 in the form of a cube-octahedron 5 wherein a number of identical rod-like members 6 are used to bridge the joints. As shown, the cube-octahedron 5 is composed of six square sides and eight triangular faces that are constructed with twelve flexible joints and twenty-four rod-like members 6. The structure 5 while freestanding maintains its cube-octahedron shape. This regular configuration is achieved by the proper selection of the elasticity of the elements, that is, the elasticity of the material of the elements must be such that the cruciform joints have sufficient strength to support the weight of the structure and preferably just sufficient to maintain the support so that maximum flexibility is retained. By varying the elasticity of individual elements in the joints different structural effects may be obtained, but for the purposes of the preferred cube-octahedron, the elasticity of the various elements should be substantially uniform.

The freestanding structure shown in FIG. 5 is readily adaptable by proper dimensioning for use as a manipulation toy. For example, by pressing on any two opposed triangular faces the joints will flex, causing the sides to reorient themselves to ultimately form an octahedron such as shown in FIG. 6. Pressing on any two opposed square faces will cause the structure to collapse into a flat configuration such as shown in FIG. 7. By rotating two opposed triangular faces the structure may be made to collapse to a flat triangle formed from three abutting isosceles triangles as shown in FIG. 8. By inverting the joints and pressing one triangular face against an opposite triangular face, the structure may be made to assume a freestanding regular bowl-like configuration having a six-pointed star base as in FIG. 9. The flexibility of the joints will also permit the internal triangular face in the FIG. 9 configuration to be rotated into congruence with the opposite triangular face to form an irregular bowl-like configuration with a triangular base. In both of the latter configurations the structure may act as a receptacle for like structures to minimize required space in packaging and shipping.

It is also possible to achieve an interesting oscillating effect with this structure by holding the palms of one's hands against opposite triangular faces and executing a clapping motion. The intermediate structure will first rotate in one direction about a normal between the palms and then return and rotate in the opposite direction. More particularly, with the structure held as indicated, when the palms of the hands are brought toward each other, the structure will collapse with the intermediate portions in combination, all executing motion in one particular direction giving the effect of a rotation about a perpendicular axis between the palms. When the hands are drawn away from each other the elastic joints will restore the structure to its unstressed cube-octahedron configuration, so that movement of all of the intermediate parts in the opposite direction will occur. This opposite motion, by virtue of the momentum of the parts, will cause them to pass slightly through their freestanding or equilibrium position, so that when the hands are quickly brought toward each other again, a rotational effect in the opposite direction about the perpendicular axis occurs. Such a repetitive or clapping motion with the hands engaging opposed triangular faces produces an oscillatory motion of the intermediate parts of the structure from one collapsed position to the opposite collapsed position with a fascinating reciprocal rotational effect about the axis through the triangular faces. As a result, it will be seen that the cube-octahedron formed in the disclosed manner offers the possibility of considerable amusement as a toy permitting deformation into many geometrical shapes by simple manipulation.

An important consideration in achieving the described flexibility and manipulatability with the preferred cube-octahedron using the flexible cruciform joints, as shown in FIG. 5, is a feature which might be referred to as "woven symmetry". By way of explanation, firstly it will be seen upon study that the cube-octahedron is symmetrical about a plane bisecting four of its square sides. Consequently, if the four joints lying in that plane were severed, or the rod-like members disconnected from the joints at the plane, two identical flat components will result, each in the form of a square having two rods extending from each of its corners essentially in a configuration such as shown in FIG. 7. Conversely, two such flat components can be used in constructing the freestanding cube-octahedron by appropriately connecting the rods extending from the square corners to four flexible joints lying in the plane. However, the desired flexibility will not be achieved automatically by connecting the rods and joints in any random manner. Rather, the connections must be made in a precise manner as follows. It will be seen that in passing around any peripheral path on the structural portions of the cube-octahedron in FIG. 5 that six flexible joints will be crossed. The necessary "woven symmetry" requires these joints to be successively oppositely arranged with respect to the inner and outer side walls of the openings therein.

More particularly, if the outer sidewalls of a given joint are arranged transversely with respect to the peripheral path, the outer sidewalls of the joints preceding and following the given joint will be disposed in alignment with the path. In other words, successive joints will be alternate in form such that the flexible elements lying along the peripheral path will alternately pass through and pass around their cooperating transversely arranged elements. It has been found that this "woven symmetry" should be followed in constructing the cube-octahedron 5 in order to achieve the desired flexibility for the above-described manipulations.

In addition to manipulating the faces of the cube-octahedron, the flexible structure 5 is particularly suitable for use as a throwing toy. If the structure is thrown or propelled with rapid rotation about the axis of any of its square faces, the resulting centrifugal force will cause it to flatten to the shape shown in FIG. 7, decreasing its air resistance and enhancing its gliding abilities, so that it may be made to travel a considerable distance. In addition, when its flight is interrupted by striking the ground or some other surface such as a window, the structure 5 tends to collapse with the propelling energy being absorbed in the flexing joints. Consequently, the impact force is minimized and the tendency to continue to travel or roll is considerably reduced so that the structure stops.

To enhance the use of the structure 5 as a throwing toy, an improved throwing device 60 of the form shown in FIG. 10 has been developed. The device comprises a handle portion 70 at one end, suitably adapted to be gripped by a player; a specially shaped central portion 80; and a loop member 90 at the opposite end. The central portion 80, in plan, has its sides tapered outwardly from the handle portion and is then bifurcated with the outer sides of the two arms 80*a*, 80*b* extending essentially parallel to each other. The loop portion 90 has two parallel arms 90*a*, 90*b*, substantially axially aligned with, and connected to, the respective ends of the bifurcated arms 80*a*, 80*b* and is rounded at its distal end 90*c*. The width of the central portion 80 and the radius of curvature of the loop's rounded end 90*c* will be such that the central portion and loop can fit through any of the open faces of the cube-octahedron toy 5. As a result, the toy 5 when thrown may be caught by skewering it with the device 60, and when the toy is so engaged the throwing device has a special feature to enhance its use in again throwing the toy. To this latter end, the central portion 80 of the device has the bifurcated arms 80*a*, 80*b* so formed that their upper and lower surfaces 80*c*, 80*d* in section are tapered toward the loop portion 90 as shown in detail in FIG. 11. Thus, when the toy 5 is skewered onto the throwing device 60, a player may then orient the device at a slight downward incline as shown in dotted lines in FIG. 10, to cause the toy to slide downwardly along the upwardly turned tapered surface 80*c* under the force of gravity. The smoothness of the rod member 6 and the weight of the toy will cause the toy when sliding to naturally tend to orient itself so that one of the flexible joints will engage the tapered surface 80*c*. At the end of the tapered surface 80*c* the sliding toy, which will have picked up some momentum, engages the surface of the loop member 90 which is arranged at a slight upward angle with respect to the tapered surface 80*c* (FIG. 11). The loop portion 90, which is preferably of plastic, is coated or covered with a suitable frictional or tacky material. The impact of the joint and connected rod 6 with the loop's surface will, due to the change in angle, absorb some of the momentum, and the flexible joint will tend to bend around the loop member, somewhat absorbing more energy and resulting in increased frictional engagement which will tend to hold the toy 5 on the loop 90. The toy 5, so held, may then be thrown to considerable distances by imparting a rotary or whipping motion to the throwing device 70 as indicated in FIG. 10.

An alternate embodiment of the cruciform flexible joint or elastic hinge of the present invention, in this instance having a unitized construction, is shown in FIG. 12. In this embodiment the vertex region or hub of the joint is integrally formed, such as by injection molding the entire piece, in order to take advantage of the features achieved with the two pieces of interconnected apertured tubing while avoiding the operation of drawing one through the aperture in the other, if mass production of the joint itself is contemplated. More particularly, the connector joint or hinge 100 is constructed with four arms 100*a*, 100*b*, 100*c*, and 100*d* arranged integrally in a cruciform manner. The arms may be entirely of a flexible material, such as rubber or a polymer, as in the prior embodiment and similarly of hollow or solid construction. The four ends may be in the forms shown in FIG. 1 or FIG. 2 or other variations as described in connection with the prior embodiment. In any event, in this embodiment at least the hub portion 100*e* of the joint will have sufficient elastic qualities to permit its deformation into suitable configurations to produce appropriate actuation of the joint. To this end, the outer surfaces of the arms at their intersection are concavely contoured to reduce their widths or diameters at, and immediately adjacent, the vertex of the joint in the manner illustrated in FIG. 12. This reduced width at the vertex permits the desired actuation of the arms thereabout and also allows for the connection of an apertured tubing element of the first embodiment type to any of the arms as shown in FIG. 13. It will be seen that this latter connection is accompanied by the tendency toward centering and interlocking in much the same manner as the two-piece joint.

The contouring of the hub 100*e* should be carefully carried out so as to maximize the distribution of surface stress which tends to focus at the vertex. While reducing the cross section adds to the elasticity and actuability of the joint, it may contribute to insufficient strength and tearing at the hub if not properly dimensioned. Thus, this integral joint should be of the same general form as the previous two-element embodiment with the width of the hub or vertex region reduced to eliminate excess material while retaining approximately the same strength in tension and bending.

It will be seen that a fundamental construction element has been disclosed, of a flexible or elastic material such as surgical tubing, which may be used with like elements to form a flexible cruciform joint that is capable of use with other structural members in assembling various geometrical structures and particularly a free-standing hollow cube-octahedron. A cube-octahedron so constructed is suitable for use as a collapsible manipulating toy and as a throwing toy in combination with a specially-designed throwing device. A unitized form of the joint has also been disclosed which may be used with the fundamental construction element in forming a multielement joint.

As used herein it will be understood that "flexible" refers to the capability of a member to be bent and return to its original configuration and condition upon the release of the bending stress, while "elastic" refers to the additional capability of being elongated and returning to the original configuration or condition upon release of the stretching stress.

What is claimed is:

1. A flexible joint comprising:

first and second lengths of flexible material each comprising means therein for defining a respective transverse opening therethrough capable of accommodating the passage of the other length of material, both of said opening defining means including elastic sidewall means for compressively surrounding said other length of material in its respective opening, and one of said lengths having said other length of material held in its respective opening with both of said openings cooperating such that the outer elastic sidewall means compressively collapses the inner elastic sidewall means to form a generally cruciform flexible joint.

2. A joint as in claim 1 wherein said first and second lengths of material comprise first and second pieces of elastic tubing of equal length with said respective transverse openings disposed intermediate their ends.

3. A joint as in claim 1 comprising means at the opposite ends of said first and second lengths of material for accommodating their connection to structural members.

4. A joint as in claim 1 further comprising a third length of flexible material having means therein for defining a transverse opening therethrough capable of accommodating the passage of said first and second lengths of material, said opening defining means including elastic sidewall means for compressively surrounding either of said other lengths of material in said opening and having one of said other lengths of material held in said opening with the three openings in approximate registration to form a universal joint.

5. A flexible joint comprising:

four arm members disposed in a cruciform arrangement; and cruciform hub means of elastic material integrally connecting said arm members for forming an actuable joint between them, said hub means having a thickness less than that of said arm members and joining with them in such manner that the inner ends of said arm members are tapered about their peripheries to merge with said hub means.

6. A flexible joint as in claim 5 wherein said arm members and hub means are integrally formed of the same elastic material and further comprising means at the outer ends of said arm members for accommodating their connection to structural members.

7. A joint as in claim 5 further comprising a length of flexible material having means therein for defining a transverse opening therethrough capable of accommodating the passage of any of said arm members, said opening defining means including elastic sidewall means for surrounding said hub means adjacent the inner ends of said arm members.

8. A construction toy comprising the combination of:

at least one generally cruciform flexible joint comprising:

four arm members disposed in a cruciform arrangement; and cruciform hub means of elastic material integrally connecting said arm members for forming an actuable joint between them, said hub means having a thickness less than that of said arm members and joining with them in such manner that the inner ends of said arm members are tapered about their peripheries to merge with said hub means; and at least one rod-like member having at least one end which is held on the outer end of at least one of said arm members.

9. A manipulatible toy comprising:

twenty-four rod-like members of identical length; and twelve flexible joint means each containing four arm members for connecting said rod-like members into six squares and eight triangles, said joint means each comprising cruciform hub means of elastic material integrally connecting said arm members for forming an actuable joint between them, said hub means having a thickness less than that of said arm members, and joining with them in such manner that the inner ends of said arm members are tapered about their peripheries to merge with said hub means.

10. A construction toy comprising the combination of:

at least one generally cruciform flexible joint formed of:

two lengths of flexible tubing, each comprising:

means for defining an axial channel extending the length of said tubing; and means for defining diametrically opposed apertures in the walls of said tubing communicating with said axial channel to form a transverse opening through said tubing capable of accommodating the passage of the other length of flexible tubing, said opening defining means including elastic sidewall means for compressively surrounding said other length of tubing to hold it in said opening;

one of said lengths of tubing having the other held in its opening with the two openings in such relationship that the outer elastic sidewall means compressively collapses the inner elastic sidewall means; and at least one rod-like member having at least one end whose width is slightly larger than that of said channels whereby said end may be compressively held therein.

11. A manipulatible toy comprising:

twenty-four rod-like members of identical length; and twelve flexible joint means each containing four legs for connecting said rod-like members into six squares and eight triangles, said joint means each comprising:

first and second lengths of flexible material; and means in both of said lengths of material for defining a transverse opening therethrough capable of accommodating the passage of the other length of material, said opening defining means including elastic sidewall means for compressively surrounding said other length of material in said opening and one of said lengths having said other length of material held in said opening with said openings cooperating such that the outer elastic sidewall means compressively collapses the inner elastic sidewall means.

12. A toy as in claim 11 wherein the six joint means along any peripheral path containing six rod-like members will have the lengths of material lying in the path successively alternate between passing through and accommodating the passage of the respective lengths of material lying across the path.

13. A toy as in claim 11 wherein said first and second lengths of flexible material comprise elastic tubing whose elasticity is such that said joint means have sufficient strength to just support the weight of each other and said rod-like members in such manner as to form a freestanding cube-octahedron.

14. A throwing toy comprising:

a freestanding collapsible cube-octahedron comprising:

twenty-four rod-like members of identical length; and twelve flexible joint means each containing four legs for connecting said rod-like members into a hollow configuration having six square and eight triangular faces; and means for engaging and holding said cube-octahedron preparatory to throwing it, comprising:

handle means for gripping by a thrower; and skewering means, connected to said handle means and comprising substantially parallel edges and a rounded end remote from said handle means, for fitting into any of the faces of said cube-octahedron.

15. A throwing toy as in claim 14 wherein said skewering means has a friction-enhancing surface thereon.

16. A throwing toy as in claim 14 wherein said skewering means further comprises two substantially parallel arms including said parallel edges and a loop member including said rounded end and the upper and lower surfaces of said arms are tapered toward said loop member to form an angle therewith.

17. A flexible joint as in claim 8 further comprising a length of flexible material comprising means therein for defining a transverse opening therethrough capable of accommodating the passage of any of said arm members, said opening defining means including elastic sidewall means for compressively surrounding any of said arm members, and said sidewall means holding the inner end of one of said arm members in said opening.

* * * * *